United States Patent [19]

Rodrigo et al.

[11] Patent Number: 4,734,580

[45] Date of Patent: Mar. 29, 1988

[54] BUILT-IN IONIZING ELECTRODE CLEANING APPARATUS

[75] Inventors: Richard D. Rodrigo, Lansdale, Pa.; Mark Blitshteyn, Edison, N.J.; Richard D. Snyder, Pennsburg, Pa.

[73] Assignee: The Simco Company, Inc., Hatfield, Pa.

[21] Appl. No.: 874,479

[22] Filed: Jun. 16, 1986

[51] Int. Cl.[4] ..... H01T 19/04

[52] U.S. Cl. ..... 250/324; 361/213; 361/230

[58] Field of Search ..... 250/324, 423 R; 361/230, 213

[56] References Cited

U.S. PATENT DOCUMENTS

| | | | |
|---|---|---|---|
| 3,120,626 | 2/1964 | Schweriner | 361/230 |
| 3,128,492 | 4/1964 | Hanscom et al. | 15/308 |
| 3,137,806 | 6/1964 | Schweriner | 361/230 |
| 3,443,155 | 5/1969 | Schweriner | 361/230 |
| 3,691,373 | 9/1972 | Compton et al. | 250/324 |
| 3,875,407 | 4/1975 | Hayne | 250/324 |
| 3,965,400 | 6/1976 | Tolliver | 250/324 |
| 4,092,543 | 5/1978 | Levy | 250/423 R |
| 4,188,530 | 2/1980 | Miller | 250/423 R |

*Primary Examiner*—Carolyn E. Fields
*Assistant Examiner*—Jack I. Berman
*Attorney, Agent, or Firm*—Stanley Bilker

[57] ABSTRACT

In combination with electrical ionizing devices (A.C. static neutralizers or D.C. charging systems) in which discharge electrodes, such as emitter points, are connected to a high voltage power supply and in adjacently spaced disposition behind a grounded foraminous grille, wiper means, such as brushes, for cleaning accumulations of particulate material electrostatically adhered to the electrodes themselves. The brushes are preferrably mounted upon the grille and have bristles passing through slots therein to enable the operator before ionization is instituted to sweep the brushes from an out-of-the-way position relative to the emerging ion flow across the electrodes to effect the cleaning and then clear of said electrodes.

9 Claims, 6 Drawing Figures

FIG.1
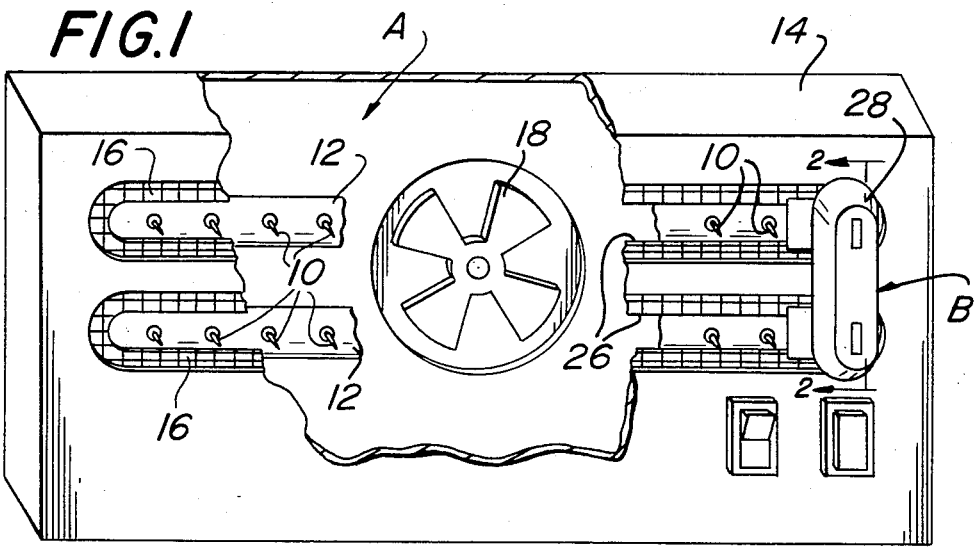
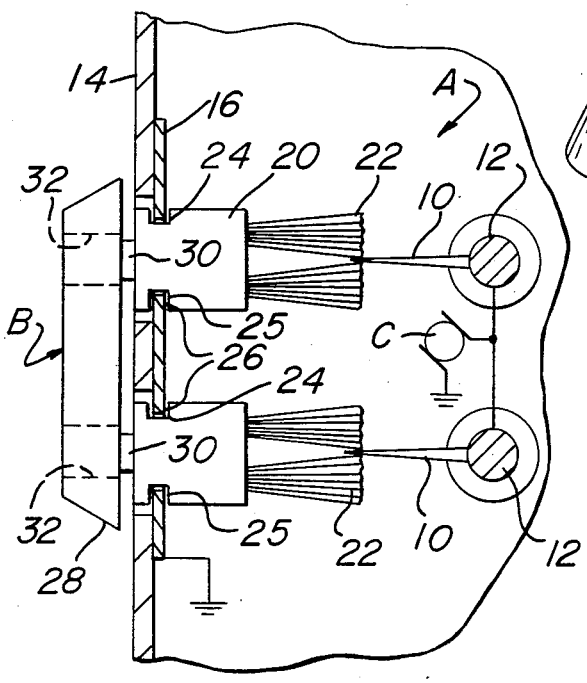
FIG.2
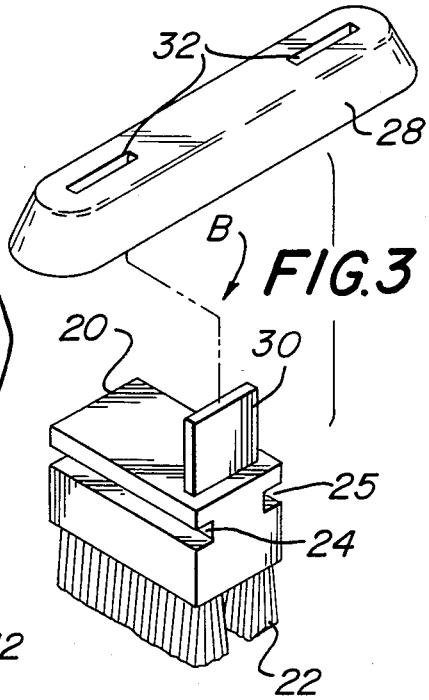
FIG.3

FIG. 4
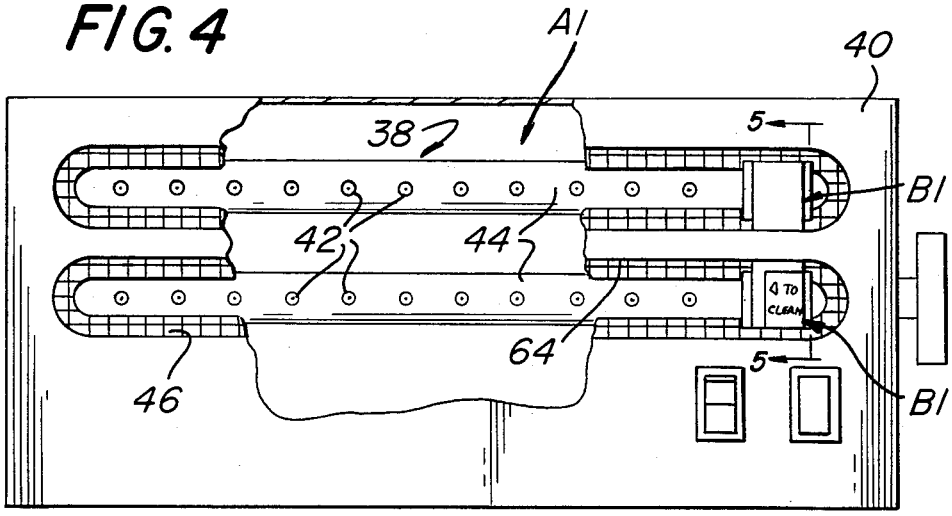
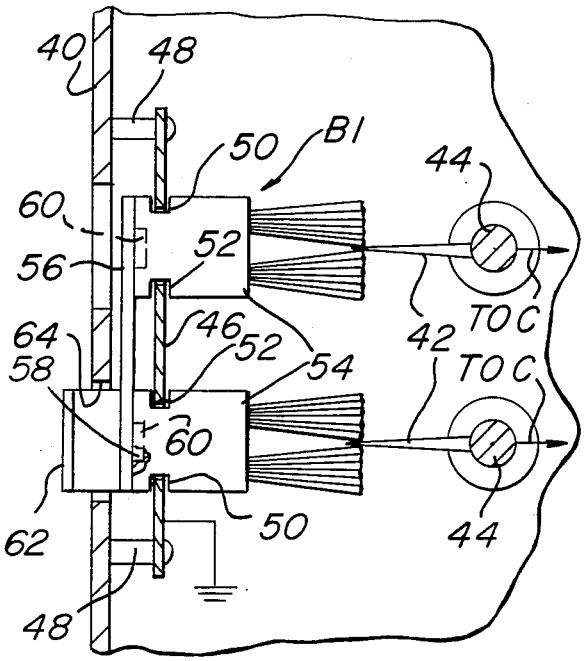
FIG. 5
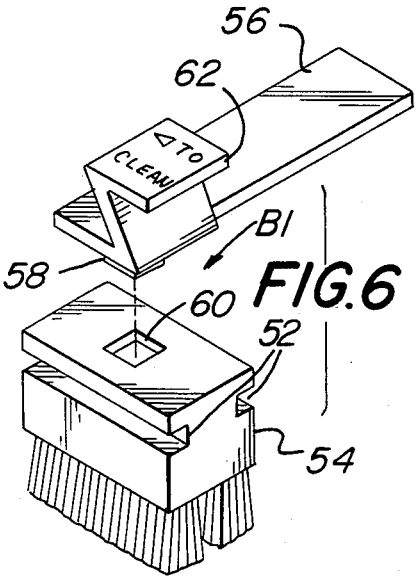
FIG. 6

BUILT-IN IONIZING ELECTRODE CLEANING APPARATUS

BACKGROUND OF THE INVENTION (1) Field of the Invention

This invention relates to corona discharging devices, and more particularly relates to ionizing devices in which one side of a high voltage power source is connected to a discharge electrode, usually of pointed disposition, and the other side connected to a conductive member, such as an apertured casing, adjacently spaced with respect to the discharge electrodes to effect emission of ions in the gap therebetween. Where a D.C. high voltage power source is connected to the discharge electrodes, ions of a single polarity are emitted from the pointed electrodes, such configurations being known as electrostatic charging devices, and where the pointed electrodes are coupled to an A.C. power source, ions of both polarities are emitted, the latter construction being termed as a static eliminator or neutralizer because of the ability of the emitted dual polarity ions to combine with particles of opposite charge to effect neutralization thereof. There are a number of ionizers presently available on the market which operate on A.C., D.C. and combinations thereof.

The present invention is especially concerned with the cleaning of the discharge electrodes, particularly emitter points, which have a tendency to accumulate dust and dirt at the tip or edge of said electrodes as a result of the electric field created thereabout. This collection of foreign particulates at the tips of the discharge electrodes reduces ion output not only in the case of D.C. charging devices but also reduces efficiency in the instance of static eliminators as well. Moreover, dirt collected on the points of static neutralizers causes the ion output to become unbalanced whereby the area at which the dual polarity ions are directed tends to become charged rather than electrostatically neutral as a result of an excess emission of ions of one polarity or the other.

(2) Prior Art

While brushes and other auxiliary cleaning devices have been employed in combination with electrostatic ionizing devices to dislodge dirt and dust particles from the surface of articles to which they electrostatically adhered (for example, see U.S. Pat. No. 3,128,492), there have been no disclosures of cleansing mechanisms shown for removal of such particulate materials building up on the points of the ionizers themselves. The accumulation of foreign particles at the tips of the discharge electrodes is especially evident in the case of extended range static eliminators where a stream of air or other gas is blown across the high voltage emitter points contained within a housing whose front surface is enclosed by a grille or screen usually connected to ground. Most ionized air blowers have a plurality of ionizing emitters, usually about twenty pointed members. See U.S. Pat. Nos. 4,092,543 and 4,188,530. In such instances, access to the discharge electrodes located behind the grille or screen has been most difficult and usually required disassembly of the enclosing housing in order to remove the accumulation of dust. The present invention is also applicable for the cleaning of the discharge electrodes of electrostatic ionizers other than those using points, for example those having elongate fine wire systems as electrodes, and emitting devices other than ionized air blowers, i.e. static bars (U.S. Pat. No. 3,443,155) nozzles and air guns (U.S. Pat. No. 3,120,626), charging bars (U.S. Pat. No. 3,137,806) and the like.

SUMMARY OF THE INVENTION

It is therefore an object of this invention to provide a built in means for cleaning dirt and dust accumulations on the discharge electrodes of electrical ionizing devices.

Another object of this invention is to provide an electrical ionizing device in which an ionizing point cleaning system is an integral part of the construction.

Still another object of this invention is to provide an electrical ionizing device in which the high voltage electrodes are swept clean by wiping a brush or similar device across the electrodes before, during or after actuation thereof.

Other objects of this invention are to provide an improved device which is easily and economically produced, sturdy in construction and highly efficient and effective in operation.

The foregoing objects are achieved by incorporating as an integral part of the electrical ionizer itself, a brush which is adapted to traverse the high voltage discharge electrodes in order to sweep them clean of any dust or dirt particles accumulating on their emitter tips. In the preferred embodiment of the invention, a bristle brush is slidably mounted within a slot formed in the grounded grille or screen which is adjacently spaced from the tips of the high voltage discharge points. When the brush is caused to traverse back and forth within the slot, the bristles thereof sweep away any particulate material which may have collected on such points.

BRIEF DESCRIPTION OF THE DRAWINGS

With the above and related objects in view, this invention consists of the details of construction and combination of parts as will be more fully understood from the following detailed description when read in conjunction with the accompanying drawings, in which:

FIG. 1 is a perspective view, and partly broken away, of an extended range electrical ionizer having a built-in brush cleaning system for removal of particulate collecting on the discharge electrodes thereof.

FIG. 2 is a sectional view taken along lines 2—2 of FIG. 1.

FIG. 3 is an exploded perspective view of one embodiment of a brush cleaning assembly pertinent to the present invention.

FIG. 4 is a front elevational view, and partly broken away, of an electrical neutralizer of the static bar type in combination with another variation of a brush sweeping mechanism embodied in this invention.

FIG. 5 is a sectional view taken along lines 5—5 of FIG. 4.

FIG. 6 is an exploded perspective view of another variation of a brush sweeping mechanism of the present invention.

In FIGS. 1 and 2, the ionizing device A that is illustrated constitutes an extended range static neutralizer in which a stream of air is blown over a series of discharge electrodes contained within an enclosing casing. The discharge electrodes are formed by affixing a plurality of pointed conductive needles 10 in parallel spaced disposition with each other upon a conductive rod 12 so that the needle points all face generally in the same direction. One or more of the conductive rods 12 are supported within the interior of housing 14 in electrically insulated disposition therefrom. The front face of the housing 14 has a conductive grille or foraminous screen 16 attached thereto in adjacently spaced disposition from the tips of the emitter points. A brush cleaning assembly, generally designated as B, is mounted upon the grille 16 where it is adapted to pass through slots therein for traverse across the point electrodes 10. The high side of a high voltage power source C is directly or capacitively or resistively coupled to the point electrodes while the ground side thereof is connected to the grille 16. The power supply C is conventional and is adapted to furnish from about 2,500 to 15,000 volts A.C. or D.C. at low amperage so as to effect ionization of the air in the gap between the tips of the points 10 and the grounded grille 16. A fan or blower 18 mounted within the housing 14 forces a stream of air through the interior of the housing across the points 10 for impingement against articles to be neutralized after exiting through the grille.

The brushes B comprise a base 20 from which protrude a plurality of tufts of relatively stiff bristles 22. The bristles 22 are preferrably non-conductive monofilaments. The base 20 is also desirably of non-conductive material to avoid interference with the discharge from the ionizing points 10 during operation of the electrostatic ionizer itself. Outwardly facing grooves 24 and 25 on the sides of the base 20 are adapted to interfit within complementary slots 26 longitudinally extending across the grille 16. The grooves 24 and 25 may be formed in any suitable manner, as by molding, machining or through the use of spacers and caps (not shown). A pair of the brushes B may be mounted in tandem by means of a yoke handle 28 attached to the base 20 by suitable inteconnecting means, such as snap tabs 30 upstanding from the base 20 and engaging slits 32 in the handle portion 28, as shown in FIG. 3.

As is apparent from the foregoing description, the brushes B are mounted so as to slide within the slots 26 of the grille 16 so that the bristles 22 contact the ionizing points 10 for effecting cleaning thereof. The initial and final position of the brushes B is at one end or the other of the casing 14 in order to be out of the way of the points 10 and not interfere with the ion stream being created and emerging from the discharge electrodes. If desired, the traverse of the brushes B can be coupled with electrical circuitry activating the power supply C whereby start-up of the ionizer is tied to a switch actuated by the placement of the brushes and wherein at least one pass of the brushes B is required to arm the power supply. It should be noted that the sweeping motion of the brushes may be accomplished either manually or mechanically.

Referring now to FIGS. 4, 5 and 6, there is shown a modified form of the instant invention in which cleaning brushes B1 are mounted upon an electrostatic neutralizer A1 which comprises one or more static bars 38 mounted to a frame 40. The static bars 38 again employ a plurality of points 42 outwardly extending from a central core 44, the points being directly or capacitively coupled to a high voltage power supply C. The electrostatic ionizers or neutralizers and the manner of coupling of the power supply C to the discharge electrodes are completely incidental to the present invention. A grille 46 is attached to the frame 40 by means of stand offs 48 inwardly projecting from the interior surface of the frame. The ground side of the grille 46 is connected to the ground side of the high voltage source C.

The brushes B1 are slidably mounted in slots 50 formed in the grille 46 by means of opposing grooves 52 set in the brush bases 54. A yoke 56 with studs or bosses 58 is adapted to couple two or more brushes B1 together when the bosses 58 are snapped into complementary detents 60 in the brush bases. The yoke 56 has a handle portion 62 at one end thereof which passes through a longitudinally extending opening 64 in the frame 40 to enable the operator to hand oscillate the ganged brushes B1 into sweeping disposition with respect to the electrode points 42. Suitable indicia may be incorporated on the face of the handle 62 to apprise the operator of the appropriate manner of sweeping the brushes. In order to change the brushes, the grille 46 may be removed from the frame 40 by unscrewing the stand-offs 48.

Again, it is apparent that the sweeping motion of the brushes may be performed manually or mechanically accomplished. In addition, materials other than brushes or bristles can be utilized to wipe the electrodes, for example, pliable substances, such as natural or synthetic rubber, may be equally suitable.

Although this invention has been described in considerable detail, such description is intended as being illustrative rather than limiting, since the invention may be variously embodied without departing from the spirit thereof, and the scope of the invention is to be determined as claimed.

What is claimed is:

1. In combination with an extended-range, dual-polarity static eliminator having a plurality of pointed discharge electrodes adapted to be coupled to a high voltage power source and arranged in at least one row enclosed within the interior of an apertured grounded housing with the pointed tips of the electrodes spaced behind an apertured protective grille of said housing, electrode cleaning apparatus comprising:

an elongated slot in said housing corresonding to each row of pointed tips and substantially coextensive therewith, brush means, including a base portion slidably supported within the edges of each slot and a bristle portion projecting therethrough for sweeping contact with the discharge electrodes, and a handle positioned external to said housing for oscillating the brush means across the tips of said electrodes to effect removal of foreign particulate material therefrom when said handle is traversed across the slot.

2. The electrode cleaning apparatus of claim 1 wherein the base portion of said brush means includes lateral grooves for interfitting with the edges of the corresponding slot.

3. The electrode cleaning apparatus of claim 1 wherein the base portions of said brush means are ganged together so that sweeping of more than one row of discharge electrodes may be accomplished simultaneously.

4. The electrode apparatus of claim 2 including a parking position for said brush means at one end of the slot to permit said brush means to be placed clear of the discharge electrodes when the ionizing device is activated.

5. The electrode cleaning apparatus of claim 1 wherein the discharge electrodes are coupled to an A.C. high voltage power source.

6. In combination with a dual polarity static eliminator having a plurality of pointed discharge electrodes arranged in a longitudinally extending row enclosed within the interior of an apertured housing with the pointed tips of the electrodes adjacently spaced from the apertured portion of said housing, and including blower means in said housing for directing air across said discharge electrodes through the apertures therefor, electrode cleaning apparatus comprising:

an elongated slot in said housing substantially coextensive with the row of pointed electrodes, a brush having a base portion slidably supported within the slot in said housing and including bristles for sweping across the tips of the electrodes, a handle positioned external to said housing and coupled to said base portion for oscillating the brush within said housing across the tips of said electrodes to effect cleaning thereof, and means associated with said handle for retracting said brush to a position clear of said discharge electrodes when said static eliminator is in use, whereby foreign particulate may be cleaned from said electrodes without interfering with static neutralization.

7. The elctrode cleaning apparatus of claim 6 including a grille having a slot whose longitudinal dimension corresponds substantially to the length of the row of discharge electrodes.

8. The electrode cleaning apparatus of claim 7 wherein the ends of said slot provide a parking position for said brush whereby the bristles thereof may be placed out of contact with and clear of any discharge electrode.

9. The electrode cleaning apparatus of claim 8 wherein the slot overlies the row of discharge points.

* * * * *